US006071437A

United States Patent [19]

Oya

[11] Patent Number: 6,071,437

[45] Date of Patent: Jun. 6, 2000

[54] ELECTRICALLY CONDUCTIVE COMPOSITION FOR A SOLAR CELL

[75] Inventor: Hirohisa Oya, Omihachiman, Japan

[73] Assignee: Murata Manufacturing co., Ltd., Japan

[21] Appl. No.: 09/258,641

[22] Filed: Feb. 26, 1999

[30] Foreign Application Priority Data

Feb. 26, 1998 [JP] Japan ..... 10-045633

[51] Int. Cl.[7] ..... H01B 1/20; H01B 1/22

[52] U.S. Cl. ..... 252/514; 252/515; 252/512; 252/518; 136/243; 136/252; 136/256; 75/252; 429/219; 429/231.5

[58] Field of Search ..... 252/514, 515, 252/512, 518; 136/243, 252, 256; 75/252; 429/219, 231.5

[56] References Cited

U.S. PATENT DOCUMENTS 3,951,872 4/1976 Neely ..... 252/514
4,486,232 12/1984 Nakatani et al. ..... 252/514
4,493,789 1/1985 Ueyama et al. ..... 252/514
5,066,621 11/1991 Akhtar ..... 501/41
5,346,651 9/1994 Oprosky et al. ..... 252/514
5,503,777 4/1996 Itagaki et al. ..... 252/518

*Primary Examiner*—Alan Diamond
*Attorney, Agent, or Firm*—Ostrolenk, Faber, Gerb & Soffen, LLP

[57] ABSTRACT

The present invention provides an improved electrically conductive composition for a solar cell. The composition of the present invention exhibits promoted grain growth and densification to thereby facilitate sintering of a thick film electrode. Moreover, the composition enables firing to be performed at a low temperature. The electrically conductive composition comprises Ag powder; at least one metal selected from among V, Mo, and W or a compound thereof; and an organic vehicle. The V, Mo, W or a compound these metals is added in an amount of about 0.2–16 parts by weight based on 100 parts by weight of the Ag powder.

8 Claims, 3 Drawing Sheets

ELECTRICALLY CONDUCTIVE COMPOSITION FOR A SOLAR CELL

BACKGROUND OF THE INVENTION

1. Field of the Invention

The present invention relates to an electrically conductive composition used in the production of solar cells.

2. Background Art

Conventionally, a composition formed by dispersing an electrically conductive powder and glass frit in an organic vehicle has been employed as an electrically conductive composition (hereinafter referred to as a conductive paste) for forming thick film electrodes in electronic elements. Such a conductive paste is applied to a ceramic substrate, a ceramic element, etc. through a method such as printing, and the resultant product is then dried and fired so as to remove organic components and sinter the conductive particles.

In recent years, thick film electrodes have demanded low-temperature firing in order to save energy and lower cost. With regard to materials which can be fired at low temperature in air, a conductive paste containing Ag powder (hereinafter referred to as Ag paste) has often been used since Ag powder is relatively inexpensive and Ag has low specific resistance. However, necking for growth of Ag grains requires a certain amount of heat during firing and can thereby result in insufficient sintering, particularly when sintering is performed at a low temperature of 700° C. or less. Therefore, desirable conductivity and film strength sometimes cannot be attained.

Meanwhile, an Ag paste containing Ag powder, glass frit and an organic vehicle is often used for forming electrodes of semiconductor elements such as Si solar cells. FIG. 1 illustrates a typical prior art Si solar cell. In the cell, an antireflection film 21 ($TiO_2$) and Ag electrodes 25 are formed on the light-accepting surface of an Si wafer 23, in which a $n^+/p/p^+$ junction has been formed, and an Al electrode 27 is formed on the back surface of the Si wafer 23. To obtain this structure, a Ag paste is applied onto the antireflection film 21 through screen printing, and fired in a near-infrared-radiation furnace. If the Ag electrodes 25 do not penetrate through the antireflection film 21 or do not establish ohmic contact with Si through an insulating film such as $SiO_2$ formed on the silicon wafer 23, the contact resistance to Si increases and thereby deteriorates the fill factor (hereinafter abbreviated as FF) which is a factor of the V-I characteristics of a solar cell. In contrast, when a Ag paste is burnt at relatively high temperature, the contact resistance decreases to enhance the FF. However, in this case, components such as Ag and glass components diffused from the electrodes destroy the pn junction of the Si wafer to disadvantageously cause deterioration of voltage characteristics.

Generally, addition of Pb or Bi to an Ag paste is known to enhance sinterability of the Ag electrodes. These additive elements provide the effect of improving sinterability of Ag electrodes when firing is performed at a temperature as high as 700° C. or more since these elements contribute to facilitation of Ag through self-vitrification. In another approach, Ag powder serving as a conductive component is finely divided in an effort to lower the sintering starting temperature. However, this approach is not practical, as it involves high costs.

SUMMARY OF THE INVENTION

In view of the foregoing, an object of the present invention is to provide an improved electrically conductive composition for a solar cell. With the composition of the present invention, grain growth and densification are accelerated to thereby facilitate sintering of a thick film electrode, and moreover, firing can be performed at a low temperature.

In a first aspect of the present invention, there is provided an electrically conductive composition for a solar cell, which composition comprises Ag powder; at least one metal selected from the group consisting of V, Mo, W and a compound thereof; and an organic vehicle.

V, Mo, W or a compound thereof which is added to an Ag paste induces a solid-state reaction with Ag particles serving as a conductive component during the firing step of the Ag paste from a low temperature region near 400° C., to thereby form a complex oxide layer on Ag particles. The formed complex oxides are $Ag_4V_2O_7$, $Ag_2MoO_4$, and $Ag_2WO_4$, when the metals are V, Mo, and W, respectively. Necking and grain growth of Ag initiate at the low temperature region since diffusion of Ag occurs via the complex oxide layer formed through the reaction. When the temperature is further elevated, a complex oxide phase generated in the Ag electrode fuses to produce a melt liquid, which promotes liquid-phase sintering of Ag particles. Thus, sintering of the Ag electrode is promoted.

When V, Mo, W or a compound thereof is added to a Ag paste which is applied to the light-accepting surface of an Si solar cell, ohmic contact with Si can be established. The reason for this is considered to be as follows. During firing of the electrode, the melt liquid of the complex oxide phase formed between Ag and the additive element fuses an antireflection film on the Si wafer and an insulating film formed of $SiO_2$. This facilitates diffusion of Ag in the insulating film. As a result, the contact resistance with respect to the Si wafer decreases. Furthermore, the solid-state reaction between Ag and V, Mo or W initiates at a low temperature and the complex oxide produced through the reaction has a low melting point. Therefore, the effect on establishing the ohmic contact is more significant than that conventionally obtained, and the amount of the additive(s) can be reduced. As a result, the present invention reliably assures Si solar cell characteristics, i.e., an excellent FF, without impairing conductivity and solderability of electrodes.

In a second aspect of the present invention, there is provided an electrically conductive composition for a solar cell, which composition comprises Ag powder; at least one metal selected from the group consisting of V, Mo, W and a compound thereof; glass frit; and an organic vehicle.

Preferably, the amount of the at least one metal selected from the group consisting of V, Mo, W and a compound thereof is about 0.2–16 parts by weight based on 100 parts by weight of the Ag powder.

When the amount is less than about 0.2 parts by weight, the effect of the additive is poor, whereas when it is in excess of about 16 parts by weight, the specific resistance disadvantageously increases. More preferably, the amount is about 0.2–3.0 parts by weight based on 100 parts by weight of the Ag powder so as to assure solderability at the bonding portion.

Also preferably, the amount of the at least one metal selected from the group consisting of V, Mo, W and a compound thereof is about 0.1–10 wt. % based on 100 wt. % of the electrically conductive composition.

When the amount is less than about 0.1 wt. %, the effect of the additive is poor, whereas when it is in excess of 10 wt. %, the specific resistance disadvantageously increases. More preferably, the amount is about 0.1–2.0 wt. % based on 100 wt. % of the electrically conductive composition so as to assure solderability at a bonding portion.

The electrically conductive composition for a solar cell according to the present invention realizes remarkably promoted sintering of the Ag electrode. Particularly, the composition enhances conductivity and film strength of a Ag electrode obtained by firing at a low temperature of 700° C. or less. Therefore, the composition according to the present invention can contribute to reduction of costs through firing at low temperature and also to formation of electrodes on a certain type of substrate (e.g., a glass substrate or an Ni-plated thermistor element) which must be treated at a temperature below an upper limit.

Thus, when the composition is employed in a Ag electrode on the light-accepting surface of an Si solar cell, the composition can form an ohmic electrode without impairing solderability, and enhance the Si solar cell characteristics as represented by FF from 0.5 (conventional) to 0.7 or more (which is a practical range). In addition, the present invention eliminates the need for post-treatment such as treatment with an acid heretofore performed to restore characteristics, since a constant FF is obtainable after firing of an electrode. Thus, the composition eventually contributes to reduction of costs for the production of solar cells.

Other features and advantages of the present invention will become apparent from the following description of the invention which refers to the accompanying drawings.

DESCRIPTION OF THE PREFERRED EMBODIMENTS

Figure 1:
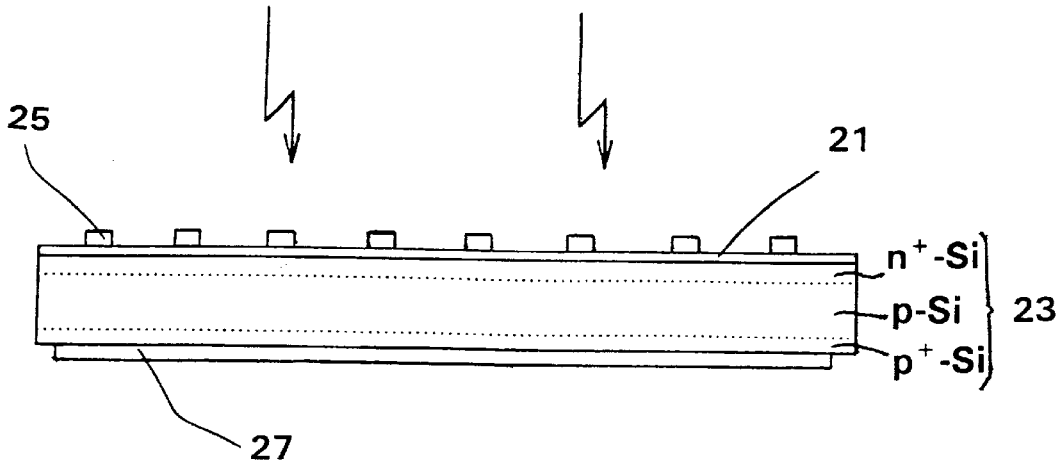
FIG. 1 is a cross-sectional view of an Si solar cell.

In connection with the above two aspects of the present invention, no particular limitation is imposed on the shape, grain size, amount, etc. of the at least one metal selected from V, Mo, and W or a compound thereof.

The compounds of V, Mo, and W are not particularly limited, and they may be oxides such as $V_2O_5$ and $MoO_3$, complex oxides such as $AgVO_3$ and $CuV_2O_6$, and organometallic compounds. When at least one metal selected from V, Mo, and W or a compound thereof is employed in an Ag electrode on the light-accepting side of an Si solar cell, the metal or a compound thereof is preferably incorporated in glass frit in an Ag paste in the form of solid solution.

No particular limitation is imposed on the organic solvent which is used in the above two aspects of the present invention, and known solvents such as α-terpineol which are commonly used in conductive pastes may be employed.

The amount and composition of the glass frit used in the second aspect of the present invention are not particularly limited. Typical examples include $PbO—B_2O_3—SiO_2$ glass, $Bi_2O_3—B_2O_3—SiO_2$ glass, and $ZnO—B_2O_3—SiO_2$ glass.

The present invention will next be described by way of examples, which should not be construed as limiting the invention.

EXAMPLES

Example 1

Ag powder having an average grain size of 1 μm and a $PbO—B_2O_3—SiO_2$-based glass frit having a softening point of 350° C., an organic vehicle prepared by dissolving cellulose resin in α-terpineol, and a metal oxide ($V_2O_5$, $MoO_3$ or $WO_3$) were mixed at the proportions shown in Table 1 and kneaded by use of a triple roll mill to obtain conductive pastes. The metal oxides had an average grain size of 1 to 3 μm. Sample Nos. 1 and 10, marked with asterisk (*), are comparative examples which do not contain the above-described metal oxides.

TABLE 1

| Sample No. | Ag Powder (wt %) | Metal oxide $V_2O_5$ (wt %) | Metal oxide $MoO_3$ (wt %) | Metal oxide $WO_3$ (wt %) | Amount of metal oxide (pbw) based on 100 parts by weight of Ag powder | Glass frit (wt %) | Organic vehicle (wt %) | Ag average grain size (μm) | Specific resistance (μΩ-cm) |
|---|---|---|---|---|---|---|---|---|---|
| *1 | 73.0 | 0 | 0 | 0 | 0 | 2.0 | 25.0 | 2.1 | 3.5 |
| 2 | 72.9 | 0.1 | 0 | 0 | 0.137 | 2.0 | 25.0 | 2.5 | 3.4 |
| 3 | 72.8 | 0.2 | 0 | 0 | 0.275 | 2.0 | 25.0 | 5.8 | 2.6 |
| 4 | 72.0 | 1.0 | 0 | 0 | 1.39 | 2.0 | 25.0 | 6.4 | 2.3 |
| 5 | 68.0 | 5.0 | 0 | 0 | 7.35 | 2.0 | 25.0 | 6.6 | 2.5 |
| 6 | 63.0 | 10.0 | 0 | 0 | 15.9 | 2.0 | 25.0 | 6.2 | 2.8 |
| 7 | 58.0 | 15.0 | 0 | 0 | 25.9 | 2.0 | 25.0 | 6.5 | 3.9 |
| 8 | 72.0 | 0 | 1.0 | 0 | 1.39 | 2.0 | 25.0 | 3.6 | 2.6 |
| 9 | 72.0 | 0 | 0 | 1.0 | 1.39 | 2.0 | 25.0 | 3.4 | 2.7 |
| 10 | 75.0 | 0 | 0 | 0 | 0 | 0 | 25.0 | 2.5 | 3.0 |
| 11 | 74.0 | 1.0 | 0 | 0 | 1.35 | 0 | 25.0 | 7.0 | 2.0 |

The resultant Ag pastes were applied onto alumina substrates by way of screen printing to thereby obtain patterns having a line width of 400 μm and a line length of 200 mm, dried at 150° C. for 5 minutes, and subjected to firing at 550° C. for 5 minutes (peak-retention time: 1 minute) through use of a near-infrared-radiation belt furnace to obtain burned Ag electrodes. Electric resistance between two ends of the conductive line and the thickness of the electrodes were measured to determine the specific resistance ρ of the Ag electrodes. Fired surfaces of the Ag electrodes were observed by use of SEM, and the average grain sizes of Ag crystalline grains were determined. The results are shown in Table 1.

As is apparent from Table 1, Ag grains in Sample Nos. 3 to 6, 8, 9, and 11 grew markedly during sintering, and their specific resistances decreased. Sample No. 2, to which small amounts of $V_2O_5$ had been added, failed to exhibit the effect of adding $V_2O_5$. By contrast, Sample No. 7 had increased specific resistance because of an excessive amount of added $V_2O_5$.

FIGS. 2 to 5 are SEM photographs of sintered surfaces of Sample Nos. 1, 4, 8, and 9. In the sintered surfaces of the Ag electrodes to which $V_2O_5$, $MoO_3$ and $WO_3$ had been added, considerably progressed necking and grain growth were observed as compared with the case of Ag electrodes containing no metal oxides. Further, a tape-peeling test revealed that the Ag electrodes formed by the Ag paste of the present invention had a film strength higher than that of the electrodes formed by Ag alone. This is considered to be attributable to the microcrystalline structure after sintering as observed in the SEM photographs.

Figure 6:
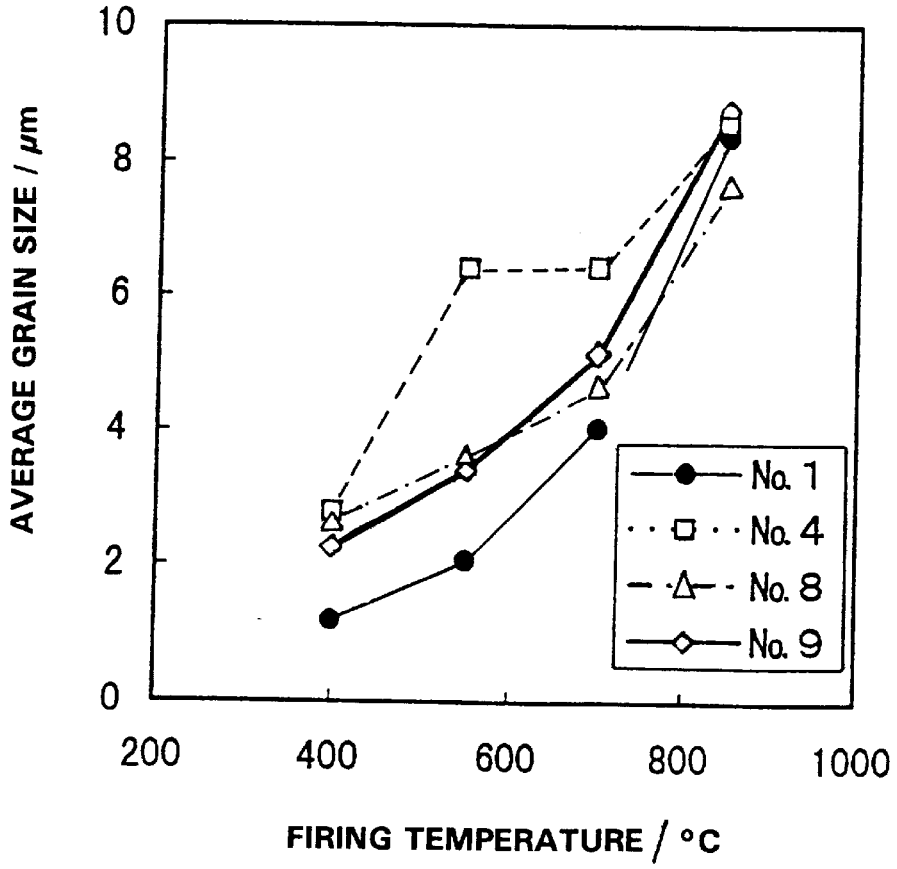
FIG. 6 is a graph showing the relationship between firing temperature and average grain sizes of sintered Ag.
Figure 2:
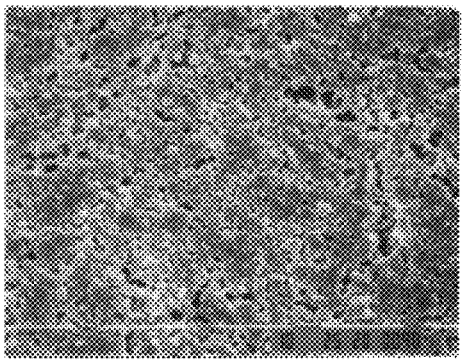
FIG. 2 is a SEM photograph of sintered sample No. 1.
Figure 3:
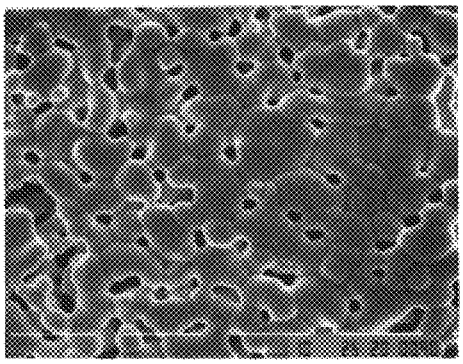
FIG. 3 is a SEM photograph of sintered sample No. 4.
Figure 4:
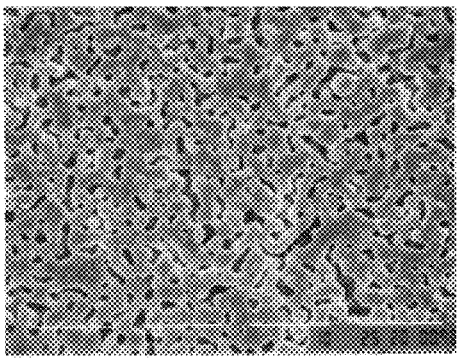
FIG. 4 is a SEM photograph of sintered sample No. 8.
Figure 5:
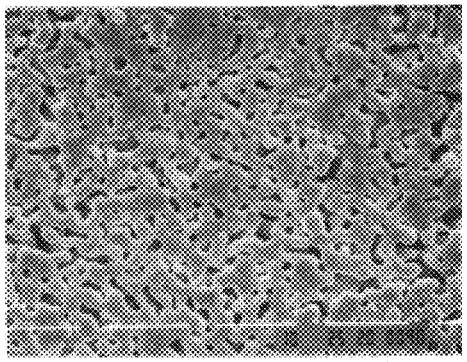
FIG. 5 is a SEM photograph of sintered sample No. 9.

The Ag pastes of Sample Nos. 1, 4, 8, and 9 were fired at different temperatures from 400 to 850° C., and the change in Ag grain size was measured by the same method as mentioned above. The results are shown in FIG. 6. As is apparent from the results, sintering of Ag electrodes can be accelerated from the low-temperature range according to the present invention.

Example 2

Ag powder having an average grain size of 1 μm and a PbO—$B_2O_3$—$SiO_2$-based glass frit having a softening point of 350° C., an organic vehicle prepared by dissolving cellulose resin in α-terpineol, and an additive ($V_2O_5$, $AgVO_3$, V resinate, $MoO_3$ or $WO_3$) were mixed at the proportions shown in Table 2 and kneaded by use of a triple roll mill to obtain conductive pastes. The metal oxides employed had an average grain size of 1 to 3 μm. Sample No. 1 marked with asterisk (*) is a comparative example which contains none of the above-described additives, and Sample 2 marked with asterisk (*) is also a comparative example to which $Ag_3PO_4$ was added as a P compound.

TABLE 2

| Sample No. | Ag Powder (wt %) | Additive: $V_2O_5$ (wt %) | V resinate (wt %) | $AgVO_3$ (wt %) | $MoO_3$ (wt %) | $WO_3$ (wt %) | $Ag_3PO_4$ (wt %) | Amount of additive (pbw) based on 100 parts by weight of Ag powder | Glass frit (wt %) | Organic vehicle (wt %) | Contact resistance Rc (Ω) | FF | Solderability |
|---|---|---|---|---|---|---|---|---|---|---|---|---|---|
| *1 | 73.0 | 0 | 0 | 0 | 0 | 0 | 0 | 0 | 2.0 | 25.0 | >50 | 0.35 | AA |
| *2 | 68.0 | 0 | 0 | 0 | 0 | 0 | 5.0 | 7.35 | 2.0 | 25.0 | 2.79 | 0.54 | CCX |
| 3 | 72.0 | 1.0 | 0 | 0 | 0 | 0 | 0 | 1.39 | 2.0 | 25.0 | 0.67 | 0.77 | AA |
| 4 | 72.0 | 0 | 1.0 | 0 | 0 | 0 | 0 | 1.39 | 2.0 | 25.0 | 0.73 | 0.75 | AA |
| 5 | 72.0 | 0 | 0 | 1.0 | 0 | 0 | 0 | 1.39 | 2.0 | 25.0 | 0.74 | 0.75 | AA |
| 6 | 72.8 | 0.2 | 0 | 0 | 0 | 0 | 0 | 0.275 | 2.0 | 25.0 | 0.80 | 0.74 | AA |
| 7 | 63.0 | 10.0 | 0 | 0 | 0 | 0 | 0 | 15.9 | 2.0 | 25.0 | 0.98 | 0.70 | BB |
| 8 | 72.0 | 0 | 0 | 0 | 1.0 | 0 | 0 | 1.39 | 2.0 | 25.0 | 0.85 | 0.73 | AA |
| 9 | 72.0 | 0 | 0 | 0 | 0 | 1.0 | 0 | 1.39 | 2.0 | 25.0 | 0.89 | 0.72 | AA |
| 10 | 71.0 | 2.0 | 0 | 0 | 0 | 0 | 0 | 2.82 | 2.0 | 25.0 | 0.70 | 0.76 | AA |
| 11 | 68.0 | 5.0 | 0 | 0 | 0 | 0 | 0 | 7.35 | 2.0 | 25.0 | 0.82 | 0.74 | AA |
| 12 | 72.9 | 0.1 | 0 | 0 | 0 | 0 | 0 | 0.137 | 2.0 | 25.0 | 0.08 | 0.74 | AA |
| 13 | 72.5 | 0.5 | 0 | 0 | 0 | 0 | 0 | 0.690 | 2.0 | 25.0 | 0.66 | 0.77 | AA |

Figure 7:
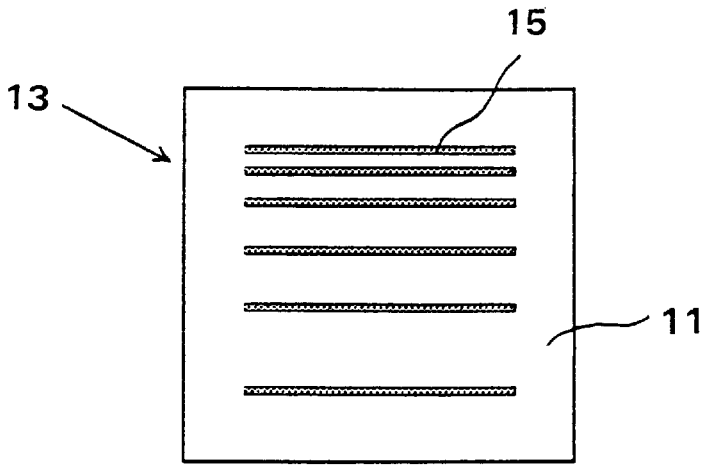
FIG. 7 is a plan view of a sample subjected to measurement of specific resistance.

Through use of patterns having different distances between electrodes 15 as shown in FIG. 7, the resultant Ag pastes were applied, by way of screen printing, onto the light-receiving side ($n^+$ side) of an Si wafer 13 which was coated with an antireflection film ($TiO_2$) 11 having a thickness of 0.1 μm. The samples were dried at 150° C. for 5 minutes, and fired at 750° C. for 5 minutes (peak-retention time: 1 minute) through use of a near-infrared-radiation belt furnace to obtain burned Ag electrodes. Electric resistances between counter electrodes having different distances therebetween were measured. The resistance when the distance between electrodes was extrapolated to zero was determined. This value was assumed to represent contact resistance Rc with respect to Si.

Figure 8:
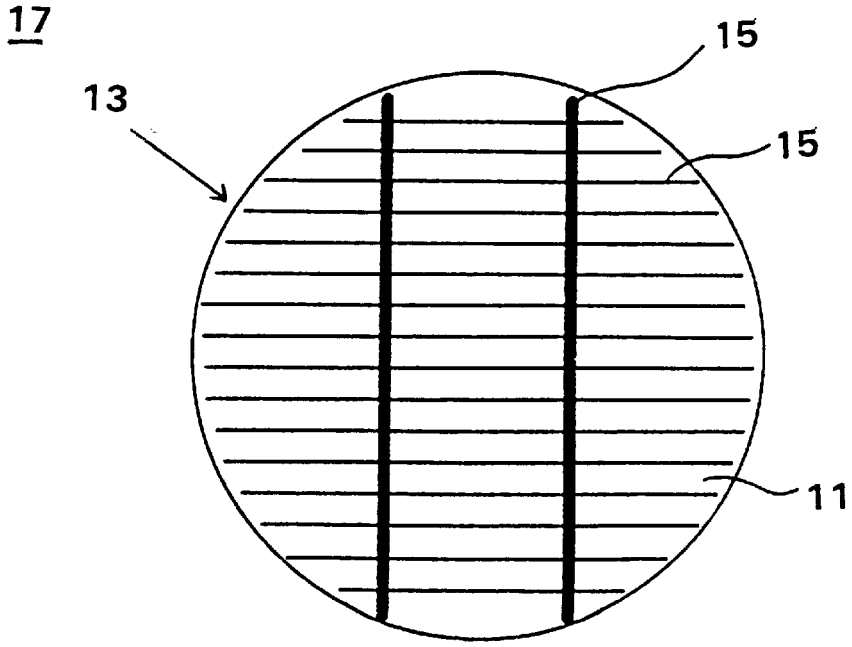
FIG. 8 is a plan view of an Si solar cell.

An Al electrode paste was provided as a coating on the entire back surface (on the p side) of a pn junction type Si wafer having a diameter of 4 inches (10.16 cm). The above-described Ag pastes were screen-printed on the light-receiving side ($n^+$ side) coated with an antireflection film ($TiO_2$) having a thickness of 0.1 μm, to obtain a lattice-shaped pattern having a line width of 200 μm and a distance between lines of 5 mm. The Ag pastes were dried at 150° C. for 5 minutes, and then fired at 750° C. for 5 minutes through use of a near-infrared-radiation belt furnace to obtain burned Ag electrodes. Thus, Si solar cells 17 as shown in FIG. 8 were obtained. With the resultant Si solar cells, FF and the solderability of the lattice-shaped electrodes were investigated. The results and the contact resistance Rc are shown in Table 2. With respect to solderability, "AA" indicates a solder-wetted area of 75% or more of the entire electrode area; "BB" indicates a solder-wetted area of 50 to 75% of the entire electrode area; and "CCX" indicates a solder-wetted area of 50% or less of the entire electrode area.

As is apparent from Table 2, Sample Nos. 3 to 13 have a reduced contact resistance of 1 Ω or less. As a result, these Samples have a remarkably improved FF (0.7 or more) as compared with the conventional pastes. Also, the Ag electrodes formed by the Ag paste according to the present invention have excellent solderability as compared with the conventional Ag electrodes to which P compounds are added. Thus, according to the present invention, not only the Si solar cell characteristics but also the solderability of the cells are improved.

While the invention has been particularly shown and described with reference to preferred embodiments thereof, it will be understood by those skilled in the art that the forgoing and other changes in form and details may be made therein without departing from the spirit of the invention.

What is claimed is:

1. An electrically conductive composition for a solar cell comprising Ag powder; about 0.2–16 parts by weight based on 100 parts by weight of said Ag powder of at least one member selected from the group consisting of Mo and W and a compound thereof and $V_2O_5$, V resinate and $AgVO_3$; glass frit; and an organic vehicle.

2. The electrically conductive composition for a solar cell according to claim 1, wherein said member is about 0.1–10 wt. % based on 100 wt. % of the electrically conductive composition for a solar cell.

3. The electrically conductive composition for a solar cell according to claim 2, wherein said member is about 0.2–3.0 parts by weight based on 100 parts by weight of the Ag powder.

4. The electrically conductive composition for a solar cell according to claim 3, wherein said member is 0.1–2.0 wt. % based on 100 wt. % of the electrically conductive composition for a solar cell.

5. The electrically conductive composition for a solar cell according to claim 4, wherein said member is selected from the group consisting of $V_2O_5$, $MoO_3$, $WO_3$, V resinate and $AgVO_3$.

6. The electrically conductive composition for a solar cell according to claim 1, wherein said member is selected from the group consisting of $V_2O_5$, $MoO_3$, $WO_3$, V resinate and $AgVO_3$.

7. The electrically conductive composition for a solar cell according to claim 6, wherein said member is about 0.1–10 wt. % based on 100 wt. % of the electrically conductive composition for a solar cell.

8. The electrically conductive composition for a solar cell according to claim 6, wherein said member is about 0.2–3.0 parts by weight based on 100 parts by weight of the Ag powder.

* * * * *